United States Patent [19]

Araya et al.

[11] Patent Number: 4,619,691

[45] Date of Patent: Oct. 28, 1986

[54] METHOD OF MANUFACTURING ULTRA-FINE PARTICLES

[75] Inventors: Takeshi Araya, Higashikurume; Akira Matsunawa, Nishinomiya; Seiji Katayama, Suita; Susumu Hioki, Kashiwa; Yoshiro Ibaraki; Yoshishige Endo, both of Ibaraki, all of Japan

[73] Assignee: Hitachi, Ltd., Tokyo, Japan

[21] Appl. No.: 795,083

[22] Filed: Nov. 5, 1985

[30] Foreign Application Priority Data

Sep. 2, 1985 [JP] Japan ..... 60-191901

[51] Int. Cl.[4] ..... B22F 9/00

[52] U.S. Cl. ..... 75/0.5 B; 75/0.5 R; 75/65 EB

[58] Field of Search ..... 75/0.5 B, 0.5 R, 65 EB

[56] References Cited

U.S. PATENT DOCUMENTS

| | | | |
|---|---|---|---|
| 3,244,412 | 4/1966 | Robinson | 75/65 EB |
| 3,364,087 | 1/1968 | Solomon | 75/65 EB |
| 4,482,134 | 11/1984 | Uda | 266/217 |

*Primary Examiner*—Peter D. Rosenberg

*Attorney, Agent, or Firm*—Antonelli, Terry & Wands

[57] ABSTRACT

A method of efficiently manufacturing ultra-fine particles of material, comprising a step of applying laser energy to the material in order to generate a plume phenomenon thereon to cause the ultra-fine particles. The material may be selected from various materials such as non-metal materials as well as metal materials.

18 Claims, 9 Drawing Figures

MATERIAL ; Ti
PRESSURE ; 1 ATM.
ATMOSPHERE ; AIR
$\tau$ ; 3.6 ms
f ; 127 mm

MATERIAL ; Ti
PRESSURE ; 1 ATM.
ATMOSPHERE ; AIR
$\tau$ ; 3.6 ms
E ; 36.5 J/P

τ ; 3.6 ms

ATMOSPHERE ; AIR

MATERIAL ; Ni

ATMOSPHERE ; AIR fd ; 10 mm

METHOD OF MANUFACTURING ULTRA-FINE PARTICLES

FIELD OF THE INVENTION AND PRIOR ART STATEMENT

The present invention relates to a method of manufacturing ultra-fine particles of materials such as not only metal or non-metal but also various chemical compounds.

In order to manufacture ultra-fine particles through an arc technique, there have been conventionally used a gas containing hydrogen, and a mechanism of the dissolving of the gas into metal, convicting and emitting thereof as disclosed in, for example, U.S. Pat. No. 4,482,134. However, no effort has been made in improving the manufacturing efficiency.

OBJECT AND SUMMARY OF THE INVENTION

An object of the present invention is to obtain a method of manufacturing ultra-fine particles of various materials with high efficiency, in which a laser energy is utilized under a condition where a plume phenomenon takes place or an energy such as an arc energy or a discharge energy is added to the laser energy.

When a laser energy is irradiated to a surface of a material, various molten states occur in dependence on its energy density. The inventors have found that a great amount of ultra-fine particles is produced under a condition that a plume phenomenon takes place. The present invention is based upon this phenomenon. The material surface is activated by the irradiation of the laser energy or an energy such as an arc energy and a discharge energy applied in addition to the laser energy to further improve the manufacturing efficiency.

DETAILED DESCRIPTION OF THE PREFERRED EMBODIMENTS

An embodiment of the present invention will now be described with reference to the accompanying drawings.

Figure 1:
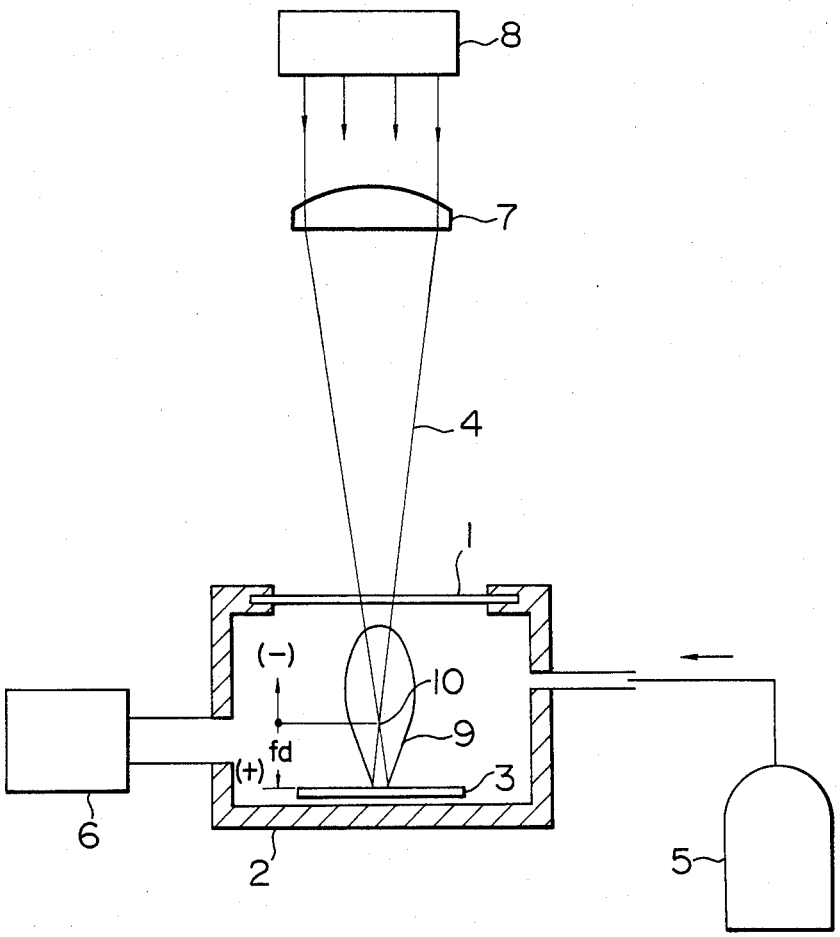
FIG. 1 is a schematic drawing showing an ultrafine particle manufacturing method embodying the invention.
Figure 2:
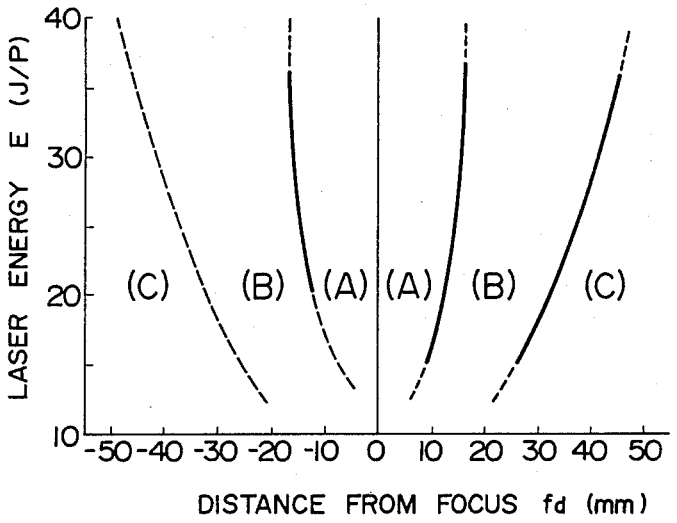
FIG. 2 is a graph showing a state of occurrence of a plume in the method of the invention, which state is interrelated with both laser energy and a distance from a focus of the laser beam.
Figure 3:
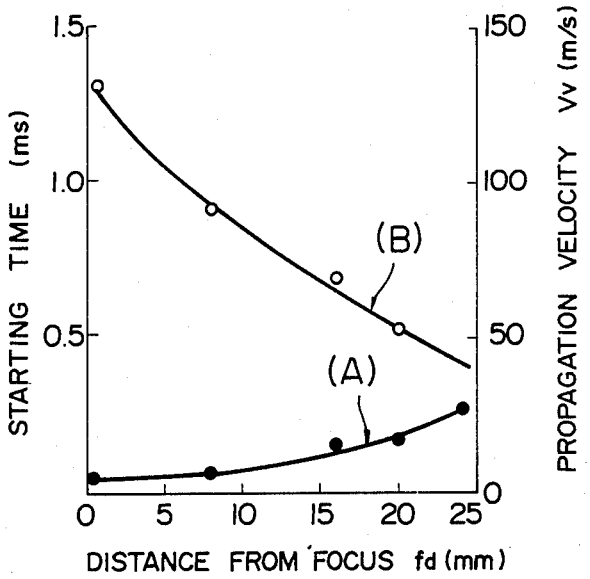
FIG. 3 is a graph showing a relationship between the distance from a focus of the laser beam, a starting time of generation of a plume, and a propagation velocity of an end of the plume, in the method of the invention.
Figure 4:
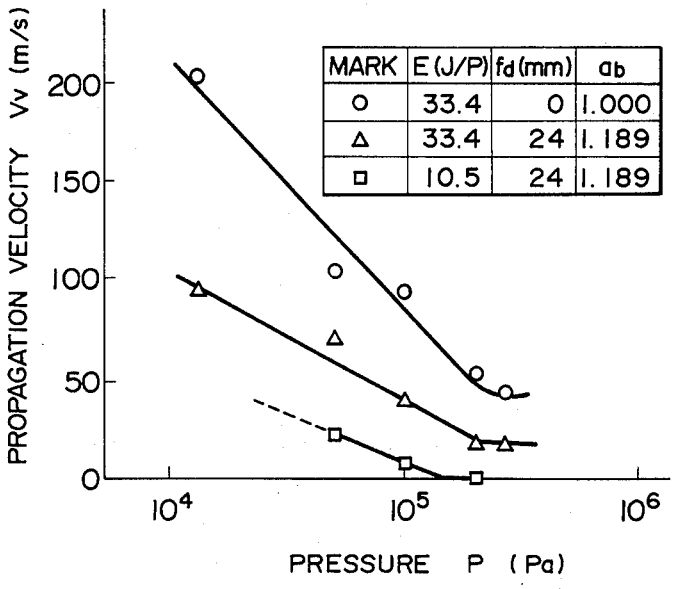
FIG. 4 is a graph showing a relationship between the pressure of a surrounding atmosphere and the propagation velocity of the end of the plume in the method embodying the invention.

In FIG. 1, a laser beam 4 (YAG laser beam) is irradiated through a glass plate 1 to a material 3 disposed in an ultra-fine particle generating chamber 2 to thereby produce ultra-fine particles, and a carrier gas ($N_2$, He, Ar, $O_2$ or the like) reserved in a gas reservoir 5 is supplied to the chamber 2 as indicated by an arrow to thereby collect the produced ultra-fine particles within a collecting chamber 6. A condenser lens 7 serves to converge the laser beam 4 irradiated from a laser beam source 8. A distance $f_d$ from the focus of the condenser lens 7 to a point in the side of the lens 7 is represented by a negative value, while a distance from the focus of the lens 7 to another point in the side of a material 3 is represented by a positive value (plus). If the energy E (Joule/Pulse) irradiated on the material surface is large, a great amount of spattering is generated, while if it is small, a small amount of metal is evaporated but it is difficult to clearly observe the metal visually or photographically. If a suitable amount of energy is irradiated to the material surface, it is possible to find out a plume 9 including a great amount of metal ultra-fine particles. The plume is defined as partly ionized metal vapor of high density occurring when a laser energy or the like is applied on the material surface, and/or the high density vapor which shines and is observed as indicated by the reference numeral 9 in FIG. 1. In FIG. 2 there is shown a relationship between the distance $f_d$ from the focus and the laser energy for obtaining the plume. In FIG. 2, A designates a region where a spatter is accompanied, B designating a region where only the plume is generated and C a region where no plume occurs. Such relation is changed depending upon a kind of the material, a surface condition, a kind of an ambient gas, the pressure of the ambient gas and the like. In the specific embodiment shown, Ti is used as the material at the ambient gas pressure P of 1 atm within the generating chamber 2; pulse time 7 of the laser being 3.6 ms; and focal length f of the condenser lens 7 being 127 mm. As a result of researches of the generation of the plume concerning various materials, it has been found that the laser energy to be irradiated to the material surface for obtaining the plume is in the range of $10^4$ to $10^7$ W/cm$^2$. On the other hand, the generation of the plume 9 needs a period of time of 0.05 to 0.3 ms after the irradiation of the laser energy E as indicated by a curve A in FIG. 3. This period of time (plume generation starting time) is changed in dependence upon the degree of the applied energy, i.e., the distance $f_d$ from the focus. Also, the propagation velocity $V_v$ of the end of the generated plume 9 is greatly changed depending on both the irradiated energy E and the ambient gas pressure P as shown by the curve B in FIG. 3 and as shown in FIG. 4. The irradiated laser energy E and the ambient gas pressure P affect the rate of generation of the ultra-fine particles, the particle diameter and the like. The sign $a_b$ in FIG. 4 denotes the ratio of $f_d$ (distance between the lens 7 and the material 3) to f (focal length of the lens 7).

Figure 5:
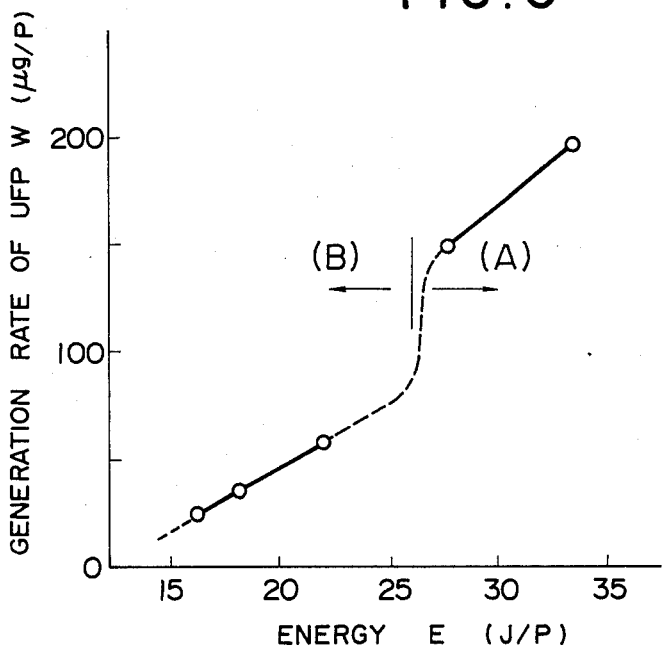
FIG. 5 is a graph showing a relationship between the laser energy and a generation rate of ultra-fine particles in the method of the invention.

Furthermore, an example of the relationship between the irradiated laser energy E and the generation rate W of the ultra-fine particles is shown in FIG. 5. From FIG. 5, it is understood that the most effective production may be attained with the energy irradiation of the region B somewhat smaller in energy level than the region A where the spatter is generated (material: Ni).

Figure 6:
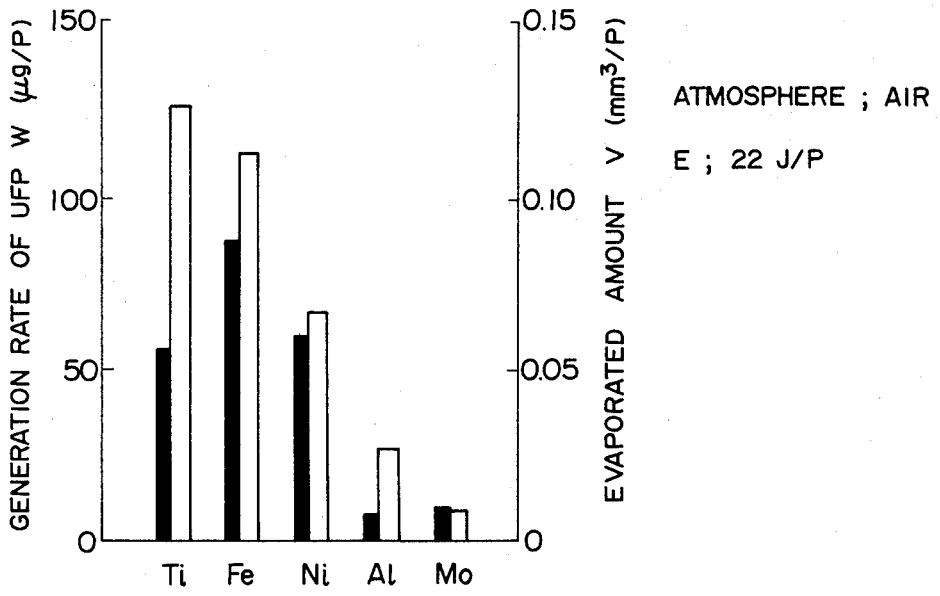
FIG. 6 is a graph showing generation rates of ultra-fine particles of various materials and evaporation amounts thereof in the method of the invention.

On the other hand, the generation rate W and the evaporation amount V upon the irradiation of a constant energy to various materials (Ti, Fe, Ni, Al and Mo) is changed largely depending upon physical properties (such as a surface absorption energy, a heat conductivity, an evaporation temperature, a melting temperature and the like) as shown in FIG. 6. Therefore, it is preferable to know in advance the energy condition where the plume phenomenon is most remarkable depending upon the kind of a material, the surface condition, the ambient gas, the atmospheric pressure, the kind of the laser, the wavelength of the laser, the kind of the optical system, the kind of the glass plate and the like, and to use an optimal energy condition.

Figure 7:
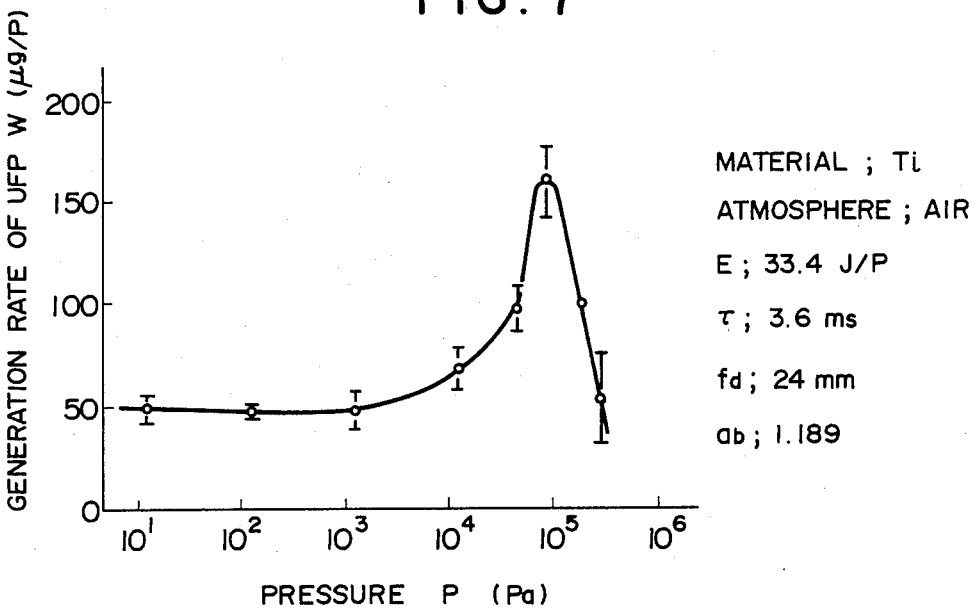
FIG. 7 is a graph showing a relationship between the pressure of surrounding atmosphere and the generation rate of ultra-fine particles in the method of the invention.
Figure 8:
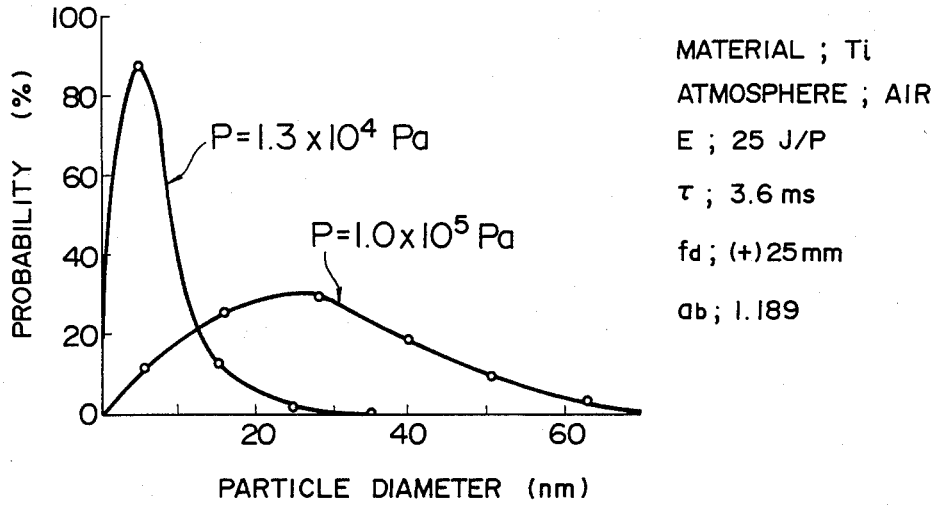
FIG. 8 is a graph showing a relationship between a diameter of the produced particle and a production probability with the pressure of surrounding atmosphere.

FIG. 7 shows a relationship between the ambient gas pressure and the generation rate of the ultra-fine particles in the case where Ti (titanium) is used as the material. As shown in FIG. 7, the generation rate is kept at a maximum when the ambient gas pressure is kept at $10^5$ Pa which is about the atmospheric pressure. As is apparent from FIGS. 4 and 7, when the ambient gas pressure is not greater than $5\times10^5$ Pa, the propagation velocity of the end of the plume is high and the generation rate is also high. Also, as shown in FIG. 8, the particle size distribution of the ultra-fine particles exhibits the particle diameter range of 5 to 65 nm at the ambient gas pressure $P=10^5$ Pa. On the other hand, at a lower ambient gas pressure of $1.3\times10^4$ Pa, the generation rate is somewhat decreased but ultra-fine particles having a uniform particle diameter (5 nm) may be obtained.

The generated ultra-fine particles are held in a very active state. Therefore, as shown in FIG. 1, when the nitrogen gas $N_2$ is used as the ambient gas, it is possible to obtain ultra-fine particle of nitride. Also, when the oxygen gas $O_2$ is used, it is possible to generate ultra-fine particles of oxide. Furthermore, since a part of the ambient gas is dissociated by the laser energy and arc energy described below, it is possible to produce ultra-fine particles of compounds such as carbides, nitride or oxide by use of a gas such as methane ($CH_4$), freon ($CCl_2F_2$) and propane ($C_3H_8$), as well as the above-described $N_2$ and $O_2$ gases.

Figure 9:
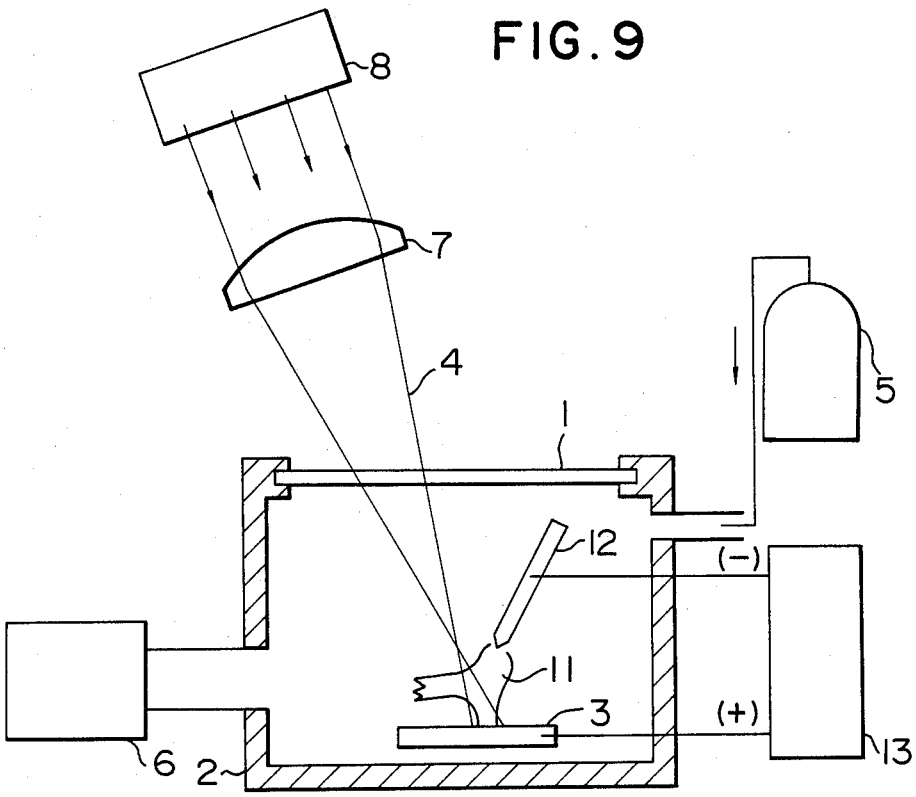
FIG. 9 is a schematic drawing showing another method of manufacturing ultra-fine particles, embodying the present invention.

FIG. 9 shows another embodiment of the invention for further improving the generation efficiency. An arc 11 (TIG arc, MIG arc, plasma arc and so on) or an electric discharge (high voltage spark, high frequency spark and so on) is applied in addition to the laser beam 4. Since the material surface is activated by the irradiation of the laser energy, a polar point of the arc or discharge may be controlled with the result that the arc energy or discharge energy becomes stable, whereby a high efficiency is ensured and a large amount of the metallic vapor may be generated. Accordingly, such a method is also available for a material having a high evaporating temperature. In the composite energy example shown in FIG. 9, an electric source 13 (D.C., pulse source or A.C. source) is connected between tungsten electrode 12 and the material 3, thereby generating arc 11 whereupon the generation rate is enhanced by inclining the electrode 12. Further, the generated ultrafine particles are transferred by electromagnetic forces, to thereby collect the particles in a collecting chamber 6.

At this time, the irradiation position of the laser beam 4 may be moved (in a rotational or parallel moving) to effectively generate the ultra-fine particles with a wide area.

In the embodiments shown, the explanation has been made as to the laser energy but it is possible to use electron beam energy in the same manner.

We claim:

1. A method of producing ultra-fine particles comprising the steps of:

irradiating a laser beam on a surface of a material;

generating a plume including ultra-fine particles by the irradiation of the material with the laser beam, said generating a plume being achieved by performing said irradiating at a suitable level; and collecting said particles.

2. The method as claimed in claim 1, wherein the irradiating is effected in a predetermined ambient gas atmosphere so that said ultra-fine particles have a desired composition, which composition is either the same as or different than said material, the ultra-fine particles having the desired composition being produced by the irradiating in the presence of said ambient gas atmosphere.

3. The method as claimed in claim 2, wherein the irradiating is effected at an ambient gas pressure adjusted such that a desired particle size distribution is produced.

4. The method as claimed in claim 3, wherein said irradiating is performed by transmitting the laser beam through a lens having a focal length, the distance from the lens to said material being a distance different than said focal length.

5. The method as claimed in claim 3, wherein, simultaneously with the irradiating, additional energy is applied to said material.

6. The method as claimed in claim 1, wherein, simultaneously with the irradiating, additional energy is applied to said material.

7. The method as claimed in claim 1, wherein said material is a metal.

8. The method as claimed in claim 7, wherein said metal is selected from the group consisting of Ti and Ni.

9. The method as claimed in claim 3, wherein an irradiation rate of the laser beam energy onto the surface of said material is in a range of $10^4$ to $10^7$ W/cm$^2$.

10. The method as claimed in claim 9, wherein said ambient gas pressure is not greater than $5\times10^5$ Pa.

11. The method as claimed in claim 9, wherein said predetermined kind of ambient gas is one selected from the group consisting of oxygen gas, nitrogen gas, methane gas, Freon gas and propane gas.

12. The method as claimed in claim 9, wherein said irradiation rate of the laser beam energy is in a range of $10^4$ to $10^7$ W/cm$^2$, the ambient gas pressure being not greater than $5\times10^5$ Pa, and said ambient gas being one selected from the group consisting of oxygen, nitrogen, methane, Freon, and propane gases.

13. The method as claimed in claim 6, wherein an irradiation rate of the laser energy onto the surface of said material is in a range of $10^4$ to $10^7$ W/cm$^2$.

14. The method as claimed in claim 6, wherein said ambient gas pressure is not greater than $5\times10^5$ Pa.

15. The method as claimed in claim 6, wherein the additional energy to be applied to the surface of said material is one selected from the group consisting of an arc energy, an electric discharge energy and an electron beam energy.

16. The method as claimed in claim 6, wherein an irradiation rate of the laser energy is in a range of $10^4$ to $10^7$ W/cm$^2$, the ambient gas pressure being not greater than $5\times10^5$ Pa, and the supplementary energy applied to the surface of said material being one selected from the group consisting of an arc energy, an electric discharge energy and an electron beam energy.

17. The method as claimed in claim 6, wherein said ambient gas is one selected from the group consisting of oxygen, nitrogen, methane, Freon and propane gases.

18. The method as claimed in claim 6, wherein an irradiation rate of the laser energy is in a range of $10^4$ to $10^7$ W/cm$^2$, the ambient gas pressure being not greater than $5\times10^5$ Pa, the supplementary energy being applied to the surface of said material, and said ambient gas being one selected from the group consisting of oxygen, nitrogen, methane, Freon and propane gases.

* * * * *